US006386517B1

(12) United States Patent
McNeill

(10) Patent No.: US 6,386,517 B1
(45) Date of Patent: May 14, 2002

(54) GARDEN BORDER FENCING SYSTEM

(76) Inventor: Kirk McNeill, 1505 Bulb Ave., Santa Cruz, CA (US) 95052

( * ) Notice: Subject to any disclaimer, the term of this patent is extended or adjusted under 35 U.S.C. 154(b) by 0 days.

(21) Appl. No.: 09/710,580

(22) Filed: Nov. 10, 2000

(51) Int. Cl.[7] ..... F04H 17/02
(52) U.S. Cl. ..... 256/33; 256/65; 256/32
(58) Field of Search ..... 256/20, 21, 1, 256/65, 67, 32, 33; 47/33

(56) References Cited

U.S. PATENT DOCUMENTS

| | | | | | |
|---|---|---|---|---|---|
| 1,142,233 | A | * | 6/1915 | Bryning | 256/33 |
| 2,248,860 | A | * | 7/1941 | Fetterman | 256/33 |
| 2,883,159 | A | * | 4/1959 | Esmay | 256/1 |
| 4,074,893 | A | * | 2/1978 | Coltrin | 256/21 |

FOREIGN PATENT DOCUMENTS

| | | | | |
|---|---|---|---|---|
| GB | 290494 | * | 5/1928 | 256/33 |

* cited by examiner

*Primary Examiner*—Lynne H. Browne
*Assistant Examiner*—Giova Collins
(74) *Attorney, Agent, or Firm*—Donald R. Boys; Central Coast Patent Agency, Inc.

(57) ABSTRACT

A border fence system is taught having at least a first and a second substantially U-shaped element, each formed from an elongated bar and having an axis of substantial symmetry, the U-shape defining an upper curved portion ending in opposite legs extending in a first direction, each element further having a single passage through the bar positioned in the curved upper portion, offset to one side of the axis of symmetry, and facing in the first direction. The fence system is characterized in that the first element is seated with both legs inserted in a ground material, the second element is seated in the same manner but with one leg inserted through the single passage of the first element, and any further element is seated with one leg inserted through the passage of an immediately preceding element. In a preferred embodiment he extended legs of individual ones of the elements are of different length and tapered at the free ends to facilitate insertion into ground. Several similar elements are taught in the fencing system.

20 Claims, 10 Drawing Sheets

GARDEN BORDER FENCING SYSTEM

FIELD OF THE INVENTION

The present invention is in the field of landscape architecture, and pertains more particularly to garden border fencing systems.

BACKGROUND OF THE INVENTION

The art of landscape architecture, the development and decorative planting of gardens, yards, grounds, and other planned outdoor spaces, is used to enhance a natural outdoor setting and to create or enhance a natural setting for buildings, recreational parks, and areas of towns and cities where a more natural or more pleasing appearance is desired. The re-creation, enhancement or alteration of existing landforms covering a large area such as a park or urban area is often the purpose of such landscape design, but is also very often applied to a smaller, more intensively cultivated area or garden, frequently created around or near a domestic building such as a home, or some other smaller structure.

Historically, such smaller gardens have been designed more for private then for public pleasure, and such landscape gardening, having its beginnings with ancient civilizations each developing their own characteristic garden designs, has evolved and diversified over the centuries to provide enhanced settings for many different cultures and traditions. Very often the aesthetic aspects of a garden or landscape include living shrubs, trees, bushes and the like, and can also include water such as lakes, streams or ponds. Flowers or other plants are also widely used for their pleasing colors or scents, and a large variety of artificial devices such as decks, pavement, terraces and so on are also commonly used. The importance of man-made components relative to natural components varies according to the designer, the purpose of particular site, and the prevailing culture and fashion.

In many applications of domestic landscape gardening, particularly those designed around or near a home, for example, there is a need for providing protection, such as from trampling or other damage, to many of the various plants, shrubs, or flowers that may be used. This is especially true when foot traffic or pets are often prevalent in the immediate area. Additionally, the landscape designer, for safety reasons, may wish to define a border providing separation between areas of the landscape garden, for example a small pond or flower bed, and an area such as a back lawn in which small children or pets may be present. In this case border fencing is often used to provide such separation between the landscaped area and public area, thereby reducing the possibility of accidents.

Such modern fencing as described just above largely consists of mass-produced, and often poorly constructed, stretches of metal, lumber, or wire, bearing little or no direct relationship to either the garden or architecture whose boundaries they are intended to define. One such example of a type most commonly used in gardens is an array of pickets, often having shaped tops, attached vertically to upper and lower horizontal beams which are subsequently attached to supporting posts permanently inserted into the ground. Such picket fencing exists in many different variations, and is often manufactured of wood but can also be of such materials as plastics, aluminum or a wide variety of other common materials.

One reason for the popularity of picket fencing is that because the spacing between pickets permits a flow of sunlight making it is possible to grow plants or flowers, for example, on either side of the fence. A major drawback with this type of fencing, however, is that regular upkeep such as periodic repair or painting is often required, particularly for poorly constructed mass produced wooden picket fences common in today's marketplace. Another common problem in using such a picket fence is that it in order to follow sharp angles or curves as defined by the proposed borderline, many smaller sections of picket fencing as well as posts are required, adding to the overall cost of installation and maintenance.

Other types of smaller and less expensive fence designs also exist, consisting of prefabricated lightweight sections, typically made of wood or plastic, each having elongated end posts enabling the section to be inserted into the ground. The finished fence is achieved by inserting subsequent sections into the ground, end-to-end along the defined border line, until the end point is reached. Such fencing is often used in temporary applications because of the ability to easily change the border definition by simply lifting fencing sections out of the ground and reinserting them in a different location. Also, such fencing is often the used more for its decorative rather than functional qualities, due to the often flimsy construction techniques and materials used in its manufacture, rendering it susceptible to jarring, displacement and deterioration. Such lightweight fencing therefore typically does not provide an adequate barrier when protection to landscape components or persons or animals is desired.

Ornamental fencing, also commonly used in many landscape designs such as described above, is commonly manufactured of metal such as iron or steel, and is widely popular for its decorative qualities as well as strength and durability. A typical ornamental fence consists of an array of bars, which can be round, square, flat or of many other shapes, and are usually interwoven or arranged in a pattern, and sometimes fastened to each other at meeting points within the design, typically using a variety of methods such as spot welding or riveting, for example.

In many designs of ornamental fencing the bars within the fence are arranged similarly to a picket fence as previously described, and supported by horizontal members which are attached to posts which may be inserted into the ground or otherwise attached to another supporting ground-level surface. Many other materials and methods are used in the manufacture of such ornamental fencing, including forged or cast steel or iron, aluminum and sometimes wood or plastics and so forth. A decorative coating, often applied using a powder-coating process known in the art, is commonly used to provide the ornamental fencing with color and a level of protection from the elements. Although the style of fencing described does often provide certain aesthetically pleasing qualities in many landscape garden designs, and usually allows for adequate sun filtration, it is often manufactured in prefabricated sections, heavy and cumbersome to handle and transport, and often requiring more elaborate processes, such as welding for example, during installation ,and is typically more expensive when compared to many other types of fencing appropriate for such a garden setting.

Stone, concrete or masonry are also materials commonly used to define a border in a landscape garden, and this kind of border is popular for its durability and low maintenance requirements, as well as the often-natural appearance of the materials used. However, unlike most picket or ornamental fencing, stone or masonry fencing usually does not allow sunlight to filter through, thereby possibly limiting the placement of plants or flowers to one side of the fence or the other. Additionally, the color choices available to the user is more limited without additional painting or staining. Another problem inherent to fences such as stone or ornamental wrought iron types as described is because of the permanency of the installed fence in many applications, any changes to the landscape or garden area, necessitating a redefinition of the border created by the fence, cannot be accomplished without a significant amount of rework involving considerable labor and time.

It is generally viewed in the art that one of the main purposes of any fencing should be not only for providing protection to landscape components and to persons or animals from potential hazards, but also to visually define the borders or limits of a particular area in a landscape while remaining an integral part of it. In order for a landscape or garden designer to accomplish this objective, the fence borderline needs to encompass the space clearly while relating cohesively to the entire landscape and architecture. Both a logical starting place and a sensible finishing point for a fence are required to provide what is to many an aesthetically pleasing design. It is preferable in many designs of landscape gardens for a structure, the side of a house or barn for example, to be the logical starting place for the fence which may be attached to the structure or not, and also for the fence line to run to a logical end point such as another structure, fence, or natural obstruction, for example. It is also desirable in many landscape garden designs to have a visual confluence of the fence and such natural objects as shrubs or bushes. In many cases a fence's border line is designed to run directly through or at the edge of such objects.

Such aesthetic effects are often difficult to achieve using common picket, stone or wrought iron fencing such as described above, especially when there is no structure or other hard surface for use as a logical starting point, or when extremely dense shrubs or other vegetation prevent or inhibit the passage of such a fence. In many cases it may be necessary to remove a portion of shrub or bush in order to achieve the desired fence line and still maintain a level of visual confluence.

What is clearly needed is an improved ornamental garden border fencing system that is visually adaptable to a wide variety of landscaping styles and sturdy enough when installed so that an adequate deterrent is provided for separation of landscape components and persons or animals. Such a fencing system would provide a finished appearance and a logical starting and ending point, not reliant on structures or other hard surfaces, while enabling visual confluence with many landscape components. Such a fencing system also would easily adapt to sharp curves or angles in a defined border line, would be easy and economical for an average user to install and maintain, would allow for full sun filtration and enable the user to quickly and easily reposition the fence if desired. The present invention builds upon previous work in the art, providing solutions to many long-standing problems and limitations inherent in conventional garden fencing systems, and is described in enabling detail below.

SUMMARY OF THE INVENTION

In a preferred embodiment of the present invention a border fence is provided, comprising at least a first and a second substantially U-shaped element, each formed from an elongated bar and having an axis of substantial symmetry, the U-shape defining an upper curved portion ending in opposite legs extending in a first direction, each element further having a single passage through the bar positioned in the curved upper portion, offset to one side of the axis of symmetry, and facing in the first direction. The fence is characterized in that the first element is seated with both legs inserted in a ground material, the second element is seated in the same manner but with one leg inserted through the single passage of the first element, and any further element is seated with one leg inserted through the passage of an immediately preceding element.

In preferred embodiments the extended legs of individual ones of the elements are of different length and tapered at the free ends to facilitate insertion into ground. Also in preferred embodiments the passage in each element is offset to one side of the axis of substantial symmetry by a dimension such that with a leg of any one element passing through the passage of any other element, both elements may be seated at the same extended height above the ground material.

In some cases the elongated bar of individual elements is formed of a malleable metal, and the metal may be wrought iron. Elements may further be protected by application of a protective coating.

"In some embodiments there are elements with double passages, one passage offset to either side of the axis of substantial symmetry, with legs of other elements of the border fence passing through each of the double passages in forming the border fence. in some cases these double-passage elements are formed to make a corner piece at a predetermined angle, which may be ninety degrees. Terminal elements are also provided, having a single leg and no passage, and the terminal elements may be decorative as well."

In another aspect of the invention an element for a border fence formed of an elongated bar having a specific cross-section is provided, and comprising an upper portion curved through 180 degrees, having an axis of substantial symmetry and a passage through the bar of a size to pass the specific cross-section, the passage offset to one side of the axis of substantial symmetry, and two parallel leg portions extending on opposite sides away from the upper curved portion in the direction of the passage and in a plane including the upper curved portion.

In a preferred embodiment of the element the leg portions are tapered at the free ends and of different length to facilitate seating the element in ground. Also in a preferred embodiment the passage is offset to one side of the axis of substantial symmetry by a dimension such that with a leg of any identical element passing through the passage of the first element, both elements may be seated at the same extended height above the ground.

The element of the invention may be formed of a malleable metal, which may be wrought iron, and elements may be treated with protective coatings. In some embodiments of the element there may be two passages, one passage offset to either side of the axis of substantial symmetry. Further, the bar of the element may be bent at the axis of symmetry at an angle in a plane parallel with ground, forming thereby a corner element. The corner may be a square corner.

In embodiments of the invention, taught in enabling detail below, for the first time a border fence system is provided which is modular, inexpensive, durable, and easy to install.

BRIEF DESCRIPTION OF THE DRAWING FIGURES

FIG. 1*a* is a front view of a first section of a border fencing system according to embodiment of the present invention.

FIG. 1*b* is a side view of the section of FIG. 1*a*.

FIG. 1*c* is a side view of the border fence section of FIG. 1*b* rotated 180 degrees.

FIG. 1*d* is a top view of the border fence section of FIG. 1*a*.

FIG. 1*e* is an enlarged view of a through-passage in the section of FIG. 1*a*.

FIG. 2*a* is a front view of a second section of border fence according to an embodiment of the present invention.

FIG. 2*b* is a side view of the border fence section of FIG. 2*a*, as seen from either side.

FIG. 2*c* is a top view of the border fence section of FIG. 2*a*.

FIG. 3*a* is a front view of a corner section of border fence according to an embodiment of the present invention.

FIG. 3*b* is a view of the corner section of FIG. 3*a* rotated 180 degrees.

FIG. 3*c* is a side view of the corner section of FIG. 3*a*.

DESCRIPTION OF THE PREFERRED EMBODIMENTS

Figure 1A:
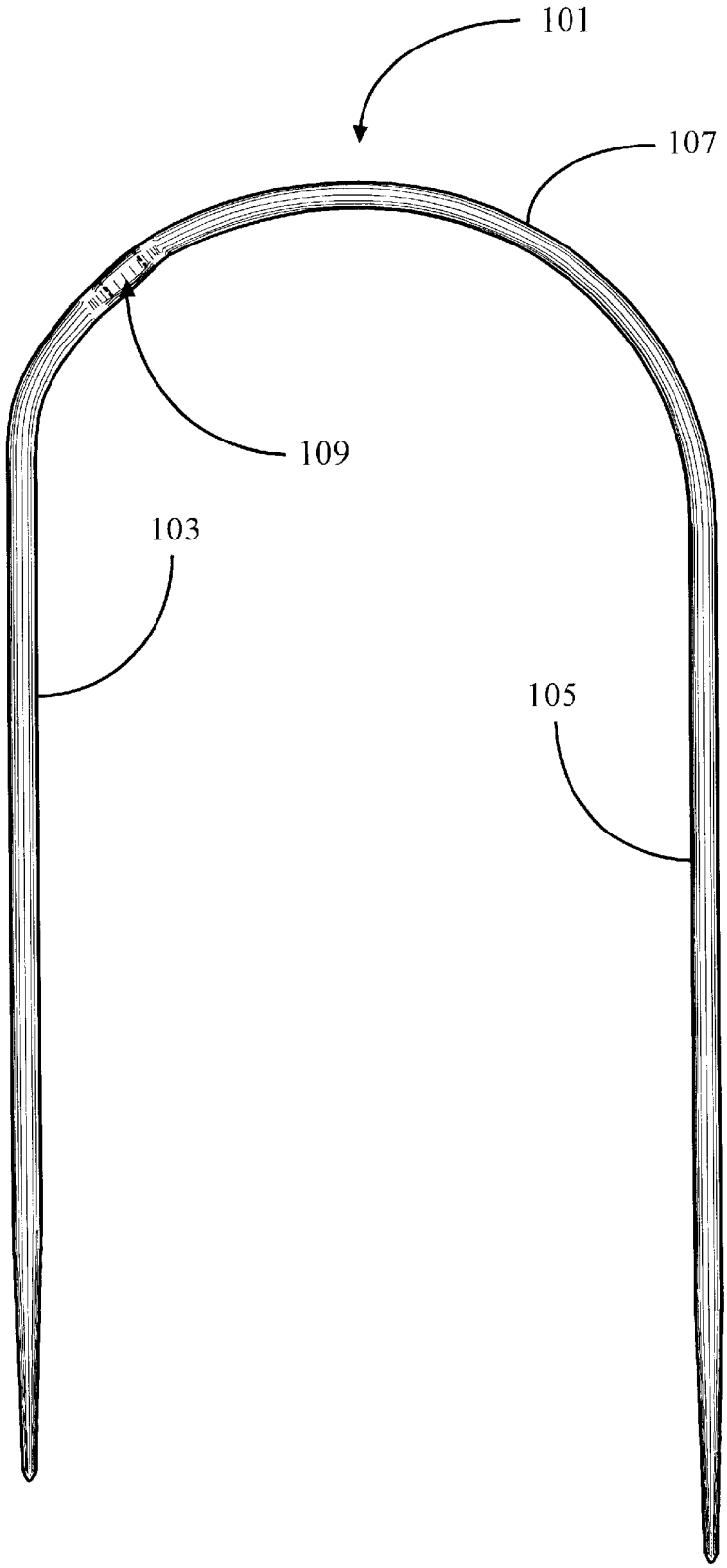

FIG. 1*a* is a front view of a first section 101 of border fence according to embodiment of the present invention. Fence section 101 is provided as one component of an improved border fencing system in this embodiment to overcome the problems and limitations inherent with many conventional garden fencing systems such as previously described in the background section. Fence section 101 in a preferred embodiment is manufactured of a bar of ornamental wrought iron, galvanized steel, or similar sturdy but relatively malleable metal, but in alternative embodiments may also be manufactured using a variety of other materials such as plastic polymers, cast aluminum and so on. In a preferred embodiment section 101 is forged or otherwise formed into a U-shape having a curved upper portion 107, substantially semi-circular in shape, with a left straight leg portion 103 and a right straight leg portion 105. Right leg portion 105 in this embodiment is of a length slightly longer than that of left leg portion 103. The shape of the circumference of metal bar used in the manufacture of fence section 101 in the embodiment shown is round and is approximately ½ inch in diameter, but can be of varying shapes such as square or rectangular, and also of larger or smaller diameters in alternative embodiments.

The lower portions of left leg 103 and right leg 105 have lower ends, similar in size and shape, tapering to substantially a point at the lower extremity. The overall height of section 101 in this embodiment as measured between the top edge of curved upper portion 107, and the pointed tip of the tapered lower end of leg 105, is approximately 29 inches, and the width as measured between the outer edges of legs 103 and 105 is approximately 15 inches. However, in alternative embodiments of the present invention the height and width can vary to suit the height requirement a user may have for the fence.

A through-passage 109 is provided in this embodiment, forged, cast or otherwise fashioned into the section of upper portion 107 near the upper straight portion of leg 103. Passage 109 is offset to one side of the center of the U-shaped section, as shown, and passes completely through the upper portion 107, and also has an inside diameter slightly greater than the largest diameter of leg portions 103 or 105. As is true for the diameter of leg portion 103 or 105, the diameter of hole 109 can also vary in alternative embodiments so long as it is of sufficient diameter to allow free and unfettered passage of a leg portion 103 or 105 of an identical second fence section 101, without excessive space remaining between the outer edges of leg portion 103 or 105 and the inner edge of hole 109.

Figure 1B:
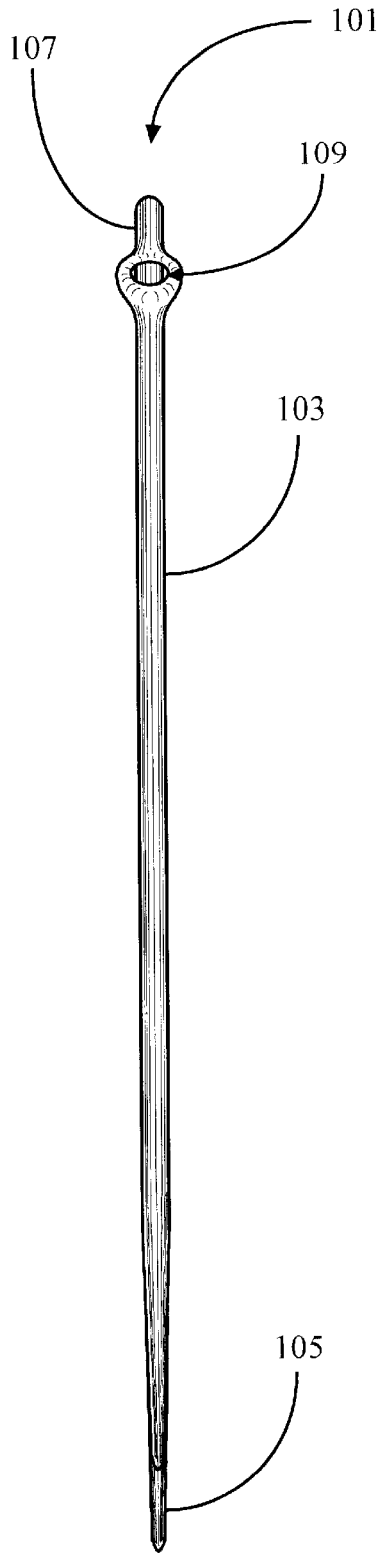

FIG. 1*b* is a side view of border fence section 101 of FIG. 1*a*. In this view passage 109 can be more clearly seen as a more direct view is provided. The round appearance of U-shaped fence section 101 is also more apparent in this view as noted by the curved upper surface of section 107. The shorter leg 103 shows in the foreground of this side view with the lower tapered end of the longer leg 105 visible and extending slightly further downward. A portion of the upper portion of leg 105 can also be seen through hole 109.

Figure 1C:
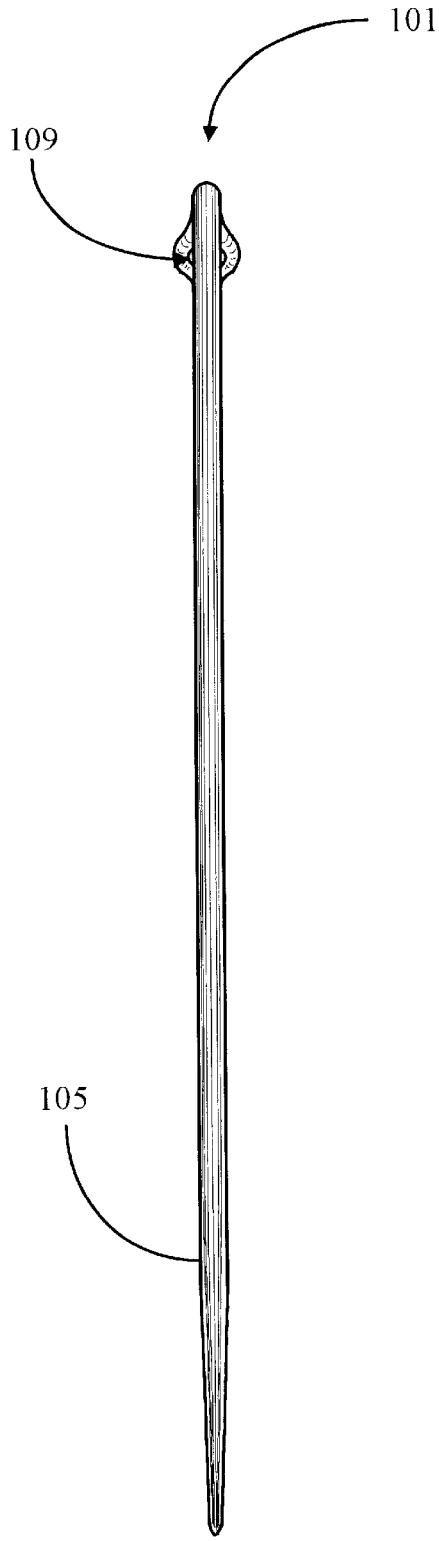

FIG. 1*c* is a side view of border fence section 101 of FIG. 1*b* rotated 180 degrees from the view of FIG. 1*b*. The longer leg 105 is visible in the foreground obscuring the view of the shorter leg 103 behind it. The opposite rounded edge of the ring-like shape bordering passage 109 is also visible in this view.

Figure 1E:
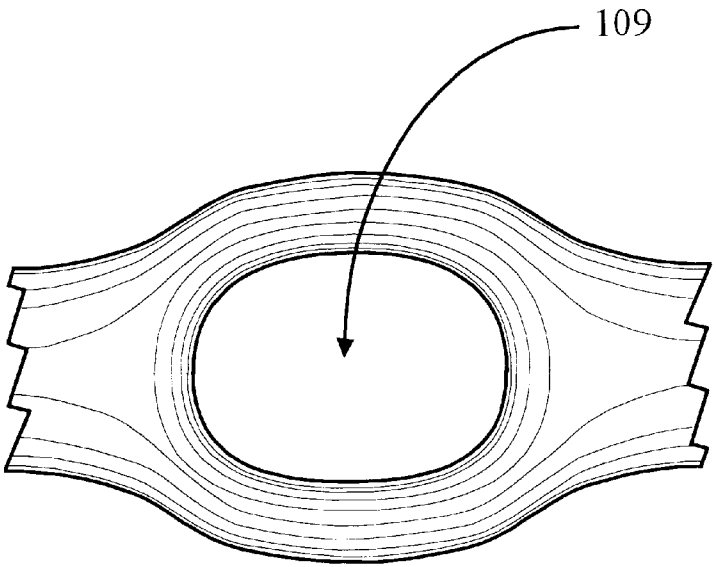
Figure 1D:
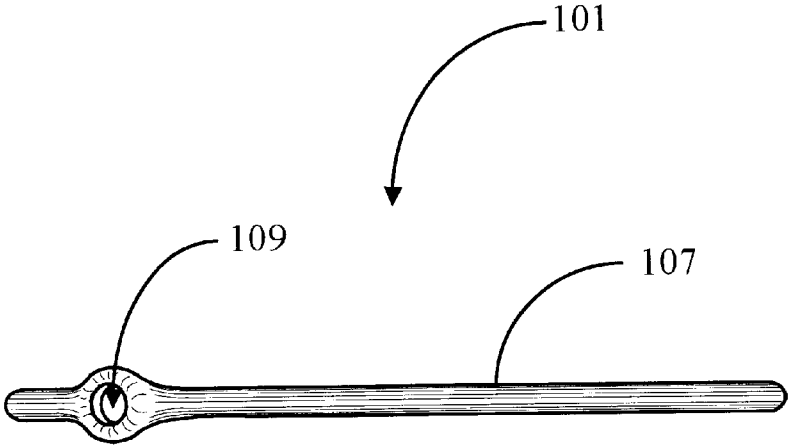

FIG. 1*d* is a top view of border fence section 101 of FIG. 1*a*. A better view of hole 109 is again provided from this viewpoint, and the rounded outer edges on each opposing side of portion 107 can also be seen.

FIG. 1*e* is an enlarged view of passage 109 of border fence section 101 of FIG. 1*a*, to show greater detail. A face-on view of passage 109 is provided to better show the shape of the oval ring-like formation providing the passage in this embodiment. In alternative embodiments however a different shape or passage size may be utilized that can depend on the style and shape of the main body of fence section 101. It is an object of the present invention to provide a border fencing solution having various modular components, including embodiments described later in greater detail, that when assembled together according to a preferred embodiment, a decorative and functional border fence is formed. It is for this reason that hole 109 in this embodiment has been designed to accommodate the insertion of a leg 103 or 105 of a second fence section 101, insertion of a leg of a third fence section 101 into a hole 109 of the second fence section 101, and so on.

A fence section as described above has a U-shape, as described, so that the elements of the section lie in a single plane. A plane at right angles to the plane of the elements of the section, parallel to the vertical legs, midway between the legs, is a plane of substantial symmetry for the section, the portions to each side being substantially a mirror image of each other, with the single exception of opening 109. The section is formed of an essentially round bar, having a first centerline, and passage 109 is an essentially round passage having a second centerline. The passage in a preferred embodiment is swaged through the bar such that the first and the second centerlines intersect; that is, the passage goes through the middle of the bar material.

The construction of a length of garden border fence can be achieved by assembling a plurality of fence sections 101 together according to an embodiment of the present invention. A first fence section 101 is inserted, typically along the border of a garden area, with the tapered ends of legs 103 and 105 pointing downward, into the earth with the end of the longer leg 105 being inserted first as a starting reference point. The tapered ends of both legs of fence section 101 are designed to ease insertion into the ground. Once the tapered end of leg 105 is inserted and effectively anchored into the ground, fence section 101 is then rotated, pivoting on the inserted leg 105, until the correct angle is achieved at which point fence section 101 is positioned by the full insertion into the ground of the tapered end of the shorter leg 103.

The fence is extended along the proposed boundary line by inserting the longer leg 105 of a second fence section 101 into hole 109 of the first fence section 101 which is now seated in the ground, lining up the ends of the second section with those of the first, passing leg 105 of the second section 101 completely through hole 109 while angling second section 101 down to aid in keeping the line even. With the tapered points at the ends of legs 103 and 105 directed straight down, the second section 101 is firmly pushed into the ground similarly to the first section 101, until the highest points of both the first and second sections are substantially even and the two sections are interlocked together. By repeating this procedure with additional sections 101 the fence can be extended along the desired fence line to any desired extent. The significance of such a design as described will become increasingly apparent as other novel elements of the current invention are described herein, and are shown assembled according to further embodiments of the present invention.

Figure 2A:
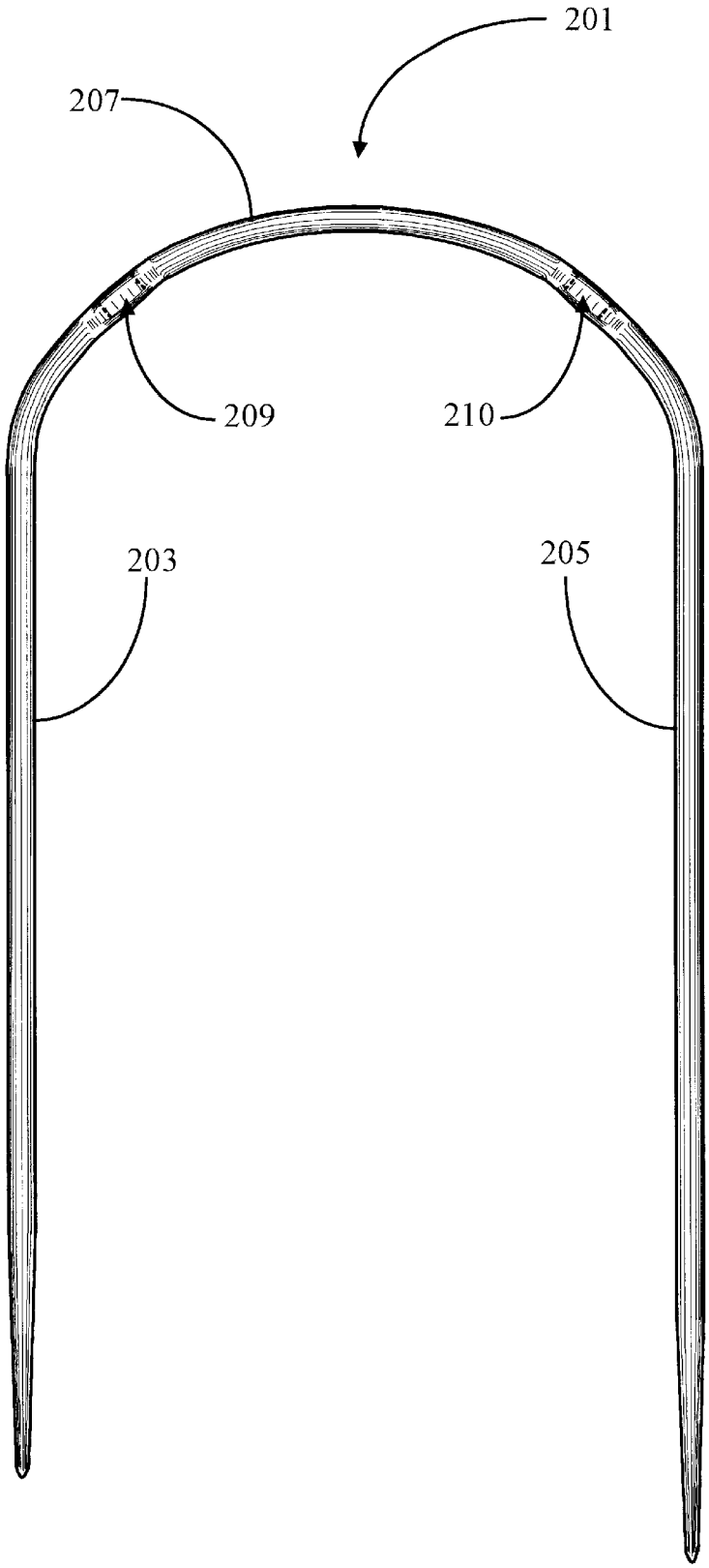

FIG. 2*a* is a front view of a section 201 of border fence according to an embodiment of the present invention. Fence section 201 is similar in overall size and shape, and has a hole 209 identical to hole 109, of fence section 101 of FIG. 1*a*, but with the addition of a second hole 210, equal in size and shape to hole 209 but located on the opposite curved end of upper portion 207. A leg 203 and a longer leg 205, both also similar in size and shape, and also both having tapered lower ends coming to a point as in legs 103 and 105 of fence section 101 of FIG. 1*a*, are also provided and are intended for the same purpose of using insertion of fence section 201 into the ground. Fence section 201 is provided as a variation of fence section 101, and can be used, for example, as a starting section for a border fence, allowing additional fence sections and other compatibly designed components, such as are described further below, to be added enabling the border fence to be extended in either direction.

Figure 2B:
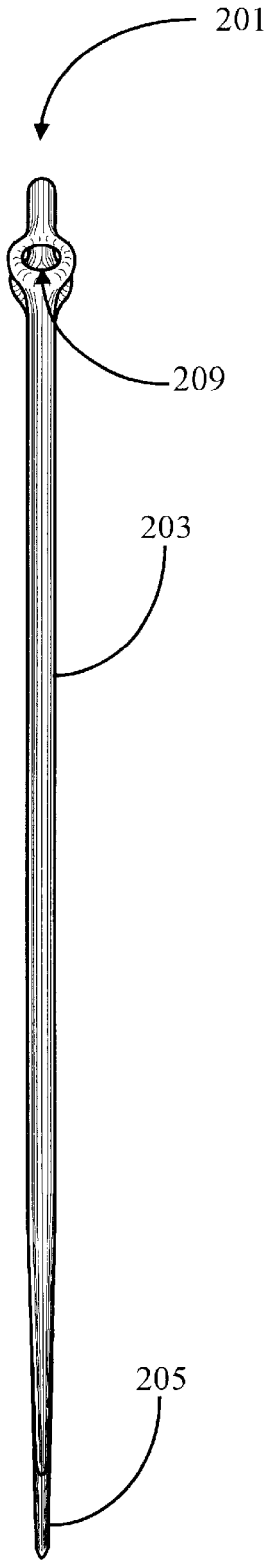

FIG. 2*b* is a left side view of border fence section 201 of FIG. 2*a*. In this view a better view of hole 209 is afforded, holes 209 and 210 also passing completely through fence section 201 as with hole 109 of fence section 101 of FIG. 1*a*. Also in this view the shorter leg 203 can be seen in the foreground, with the lower tapered section of the longer leg 205 visible in the background.

Figure 2C:
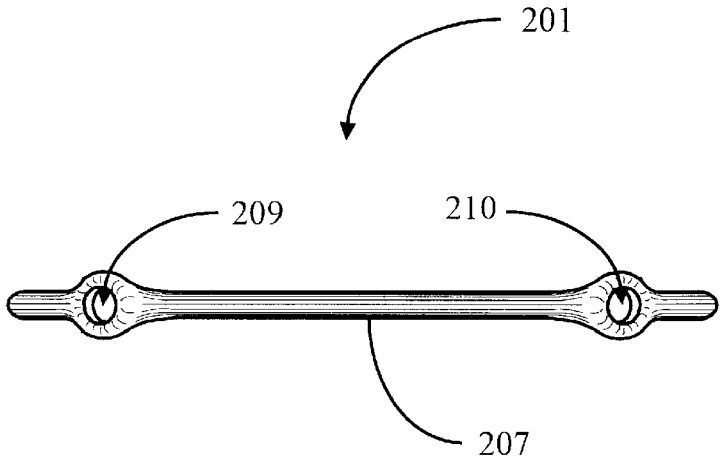

FIG. 2*c* is a top view of border fence section 201 of FIG. 2*a*. The shape of both holes 209 and 210 can be clearly seen in this view, as can their opposite positions on the upper portion 207. As is true for some elements and properties of a fence section such as section 101 of FIG. 1*a*, the size and shape of holes 209 and 210 and the body of section 201 can vary in alternative embodiments without departing from the overall scope and spirit of the present invention.

Figure 3A:
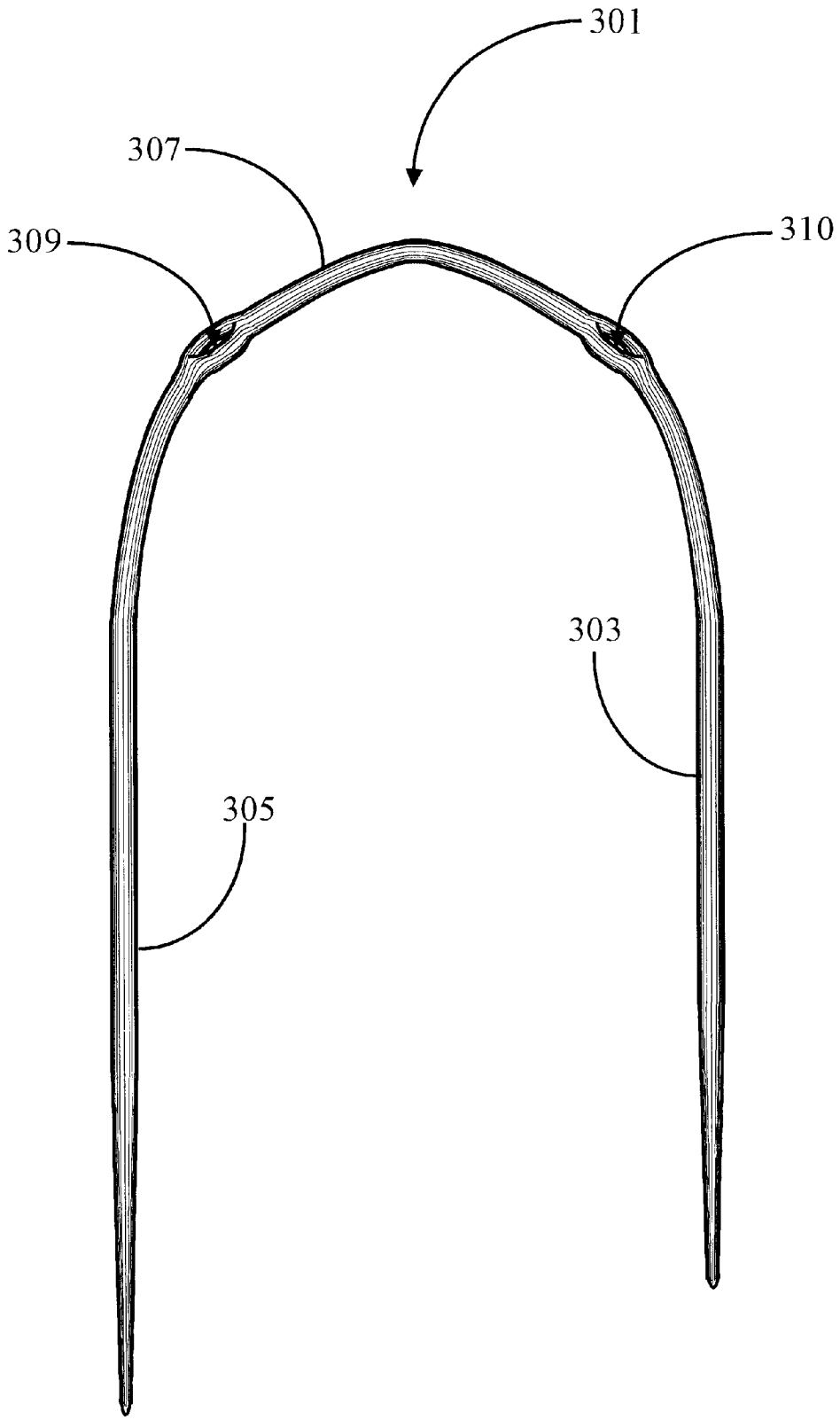

FIG. 3*a* is a front view of a corner section of border fence according to an embodiment of the present invention. Corner section 301 is provided in this embodiment as a functional component to be used integrally with other components that have been, and will be described, to form a variety of decorative ornamental garden fence arrangements. Corner section 301 is manufactured using materials and methods similar to those described for fence sections 101 and 201, and is also U-shaped to a certain degree, similarly to sections 101 and 201, and shares other obvious similarities such as legs 303 and 305, leg 305 being slightly longer than leg 303, and both having similar lower ends tapered to a point. The longer leg 305 however, in this embodiment, is located on the left side when corner section 301 is viewed from the front, instead of on the right side, as is the longer leg 105 of fence section 101. Holes 309 and 310, also similar in this embodiment, in size and shape to those of sections previously described and are located on opposite sides of the upper and curved portion 307 similarly to the positioning of holes 209 and 210 of section 201 of FIG. 2*a*. Unlike fence sections 101 and 201 however, the curved upper portion 307 in this embodiment comes to a meeting point at the top forming an angle that is somewhat sharper than that formed by the more rounded upper portions 107 or 207 shown earlier in FIGS. 1*a* and 2*a*.

In addition to the above, the center top portion of upper portion 307 is set back significantly, approximately four inches from parallel with legs 303 and 305 in this embodiment, towards the rear, and meeting at a center point in the rear. This angle is shown from a different perspective providing better detail in depictions forthcoming. The overall height of corner section 301, as measured from uppermost edge of upper section 307 and the pointed end of the longer leg 305, is somewhat smaller than that of sections 101 or 201, equally approximately 22 inches in this embodiment. The width of corner section 301 as measured between the outermost edges of legs 303 and 305 is also smaller as compared to that of sections 101 or to 201, equally in this embodiment approximately 11 inches. The intentional smaller design of corner section 301 is intended to both provide an aesthetically pleasing appearance when assembled with other components into a fence system according to a preferred embodiment of present invention, as well as facilitating easier insertion of sections 101, for example, when starting a fence assembly.

Corner section 301 is designed for use as a starting point for two different fence lengths extending outward from and forming a 90-degree angle in this embodiment. Corner section 301 provides a key advantage to the user by eliminating the need for a structure, wall or other hard surface to be used as a logical starting point for a decorative fence. Instead, the logical starting point for such a fence that extends out in two different directions is easily created simply by placement and insertion into the ground of corner section 301 in a location suitably adapted and integral with the chosen landscape design. One side of the decorative fence is extended out from corner section 301 by inserting the longer leg 105 of a fence section 101, for example, completely through either hole 309 or 310 of corner section 301, angling section 101 down to keep it in line with the desired fence line, and firmly inserting section 101 straight down into the ground. The process described is identical to that used for assembling multiple sections 101 together as described previously.

Figure 3B:
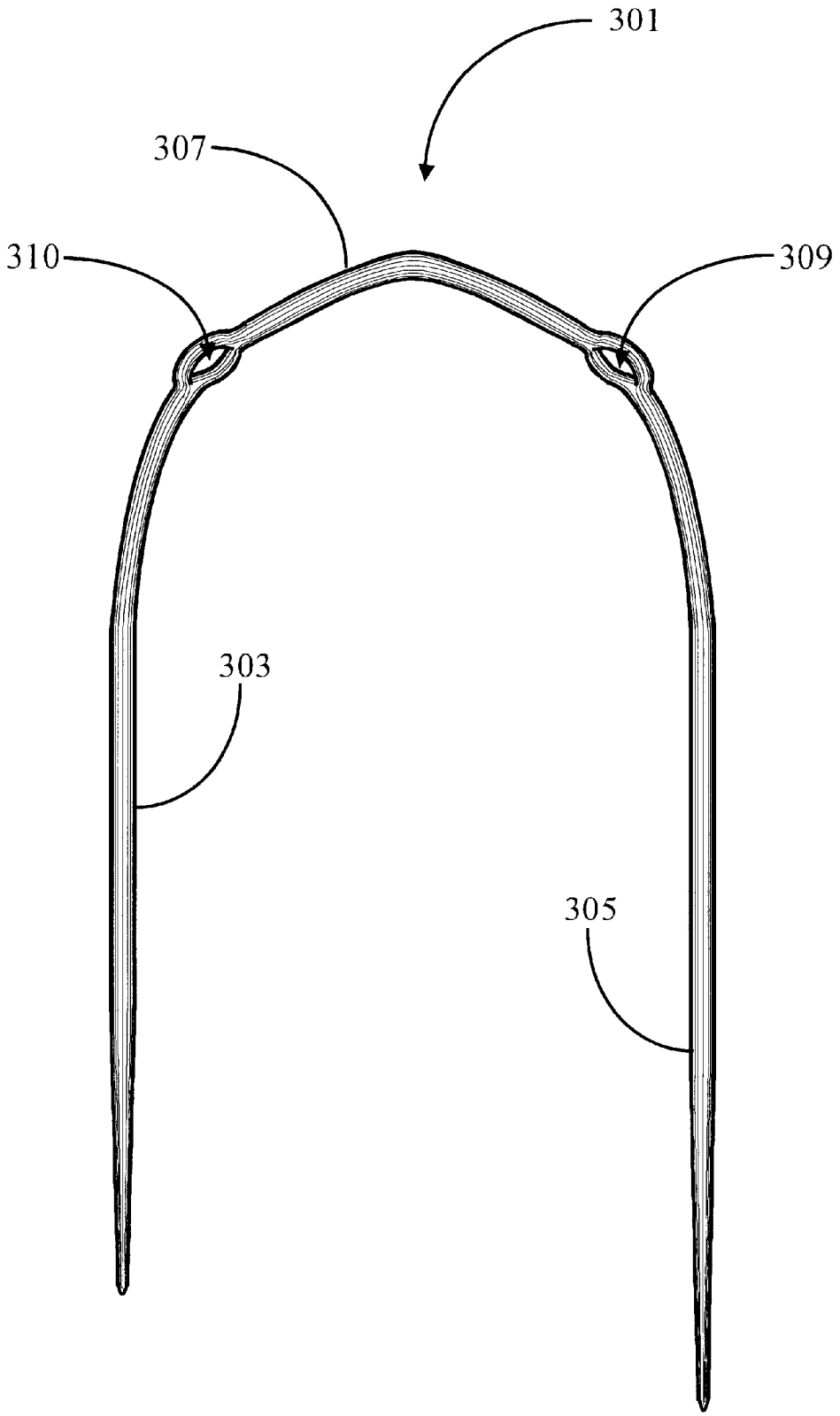

FIG. 3*b* is a perspective view of the corner section of FIG. 3*a* rotated 180 degrees. In this view a perspective of the angle of holes 309 and 310 in relation to upper portion 307 is provided with the uppermost center meeting point of upper portion 307 now in a forward position towards the viewer. Elements 303 and 305 are also identified in this view to provide perspective.

Figure 3C:
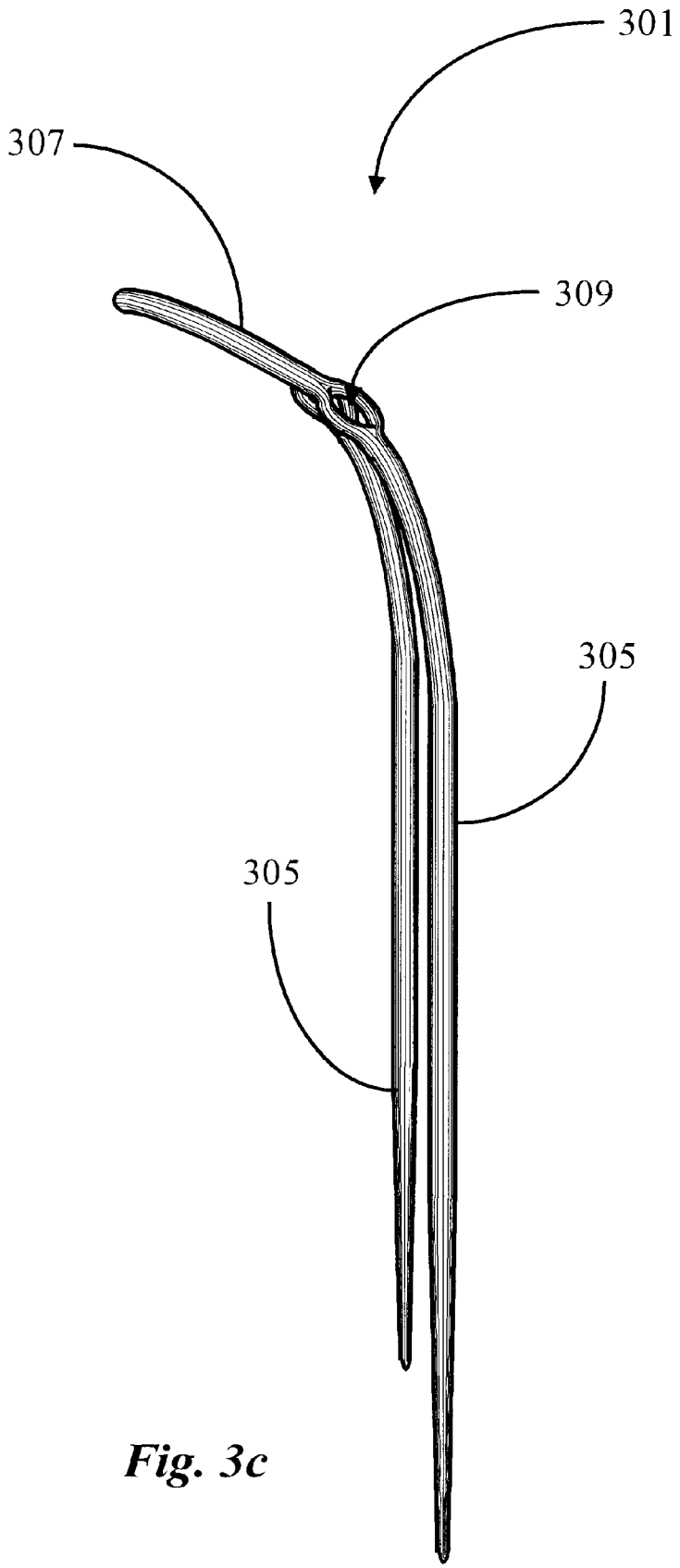

FIG. 3*c* is a side view of corner section 301 of FIG. 3*a*. In this view, section 301 of FIG. 3*b* is rotated 90 degrees clockwise from its rear-facing position as shown in FIG. 3*b*. The degree of rearward offset designed into the curved upper portion 307 in this embodiment becomes apparent in this view, which also provides a clearer indication of the locations of hole 309 and hole 310, which is mostly obscured from view here by hole 309. The longer leg 305 is shown in the foreground in this perspective view, with the shorter leg 303 shown in the background.

Figure 4:
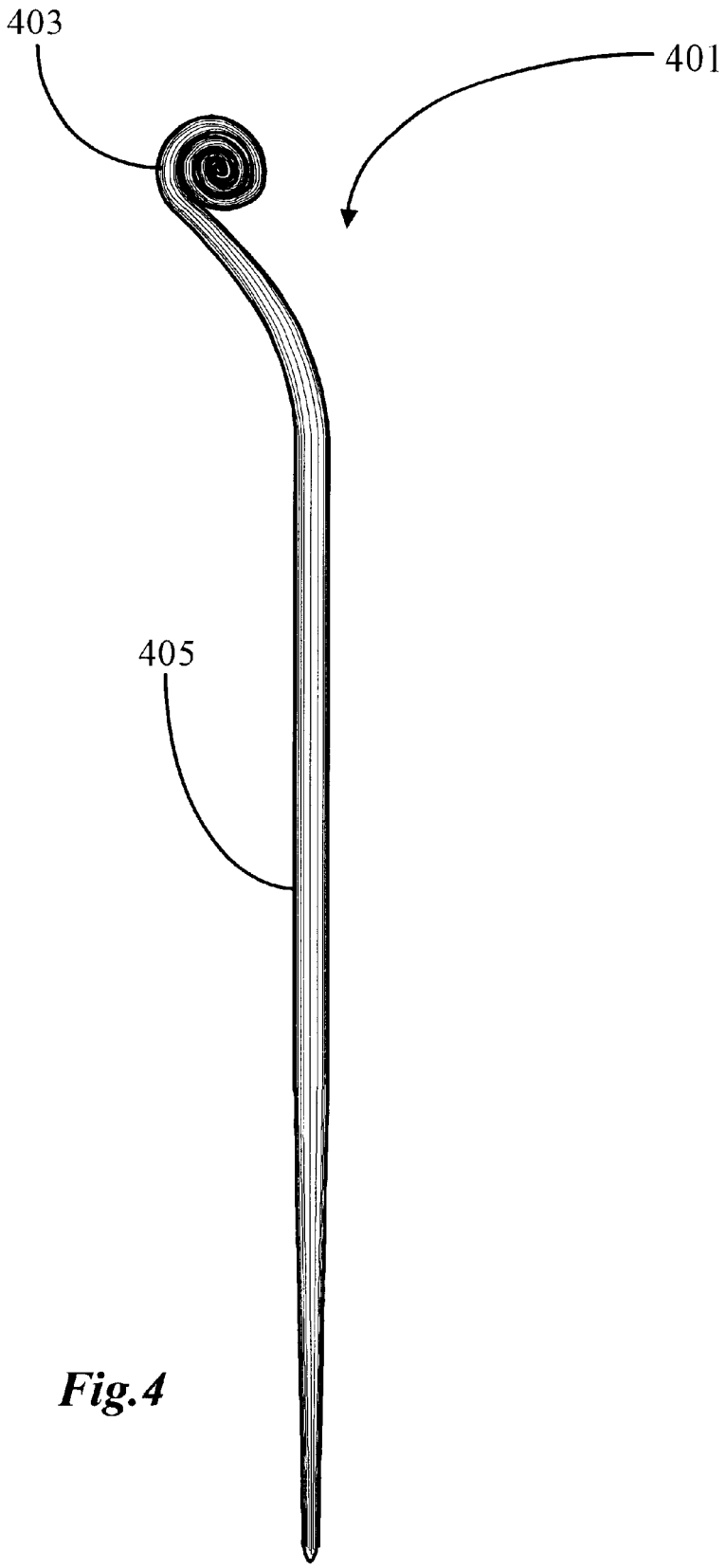
FIG. 4 is a view of an end section of border fencing according to an embodiment of the present invention.

FIG. 4 is an elevation view of an end section of border fencing according to an embodiment of the present invention. End section 401 is provided in this embodiment as another decorative component used as an integral part in an improved modular ornamental fencing system. End section 401 is also manufactured using similar materials and methods to those used for previously described components in embodiments described above. A straight leg 405 is provided having a lower end tapering to a point also similarly to that of the legs of fence section 101, for example, to provide for easier insertion into the ground. The rounded tubular shape, and largest diameter of the main portion of leg 405 is also roughly equal to that of fence sections previously described, approximately ½ inch in this embodiment, also allowing for easy insertion through a hole such as hole 109 of fence section 101 of FIG. 1*a*, for example. The overall height of end section 401 in this embodiment is slightly less than that of the overall height of fence sections 101 or to 201, and slightly greater than that of corner section 301, approximately 25½ inches. However, as is true for embodiments previously described, the shape, size, dimensions of some elements, and materials and manufacturing methods used can vary in alternative embodiment without departing from the key overall objects of the present invention.

Beginning at the top of leg 405, an upper portion 403 is provided consisting of a continuation of leg 405, slowly tapering along its length until the end, and formed by hand, casting, or some other method into the decorative coil, ending in the center as shown. In alternative embodiments of this decorative end section many different designs may be incorporated into the upper portion in lieu of a round coil such as shown, depending on the particular tastes of the designer or user.

Figure 5:
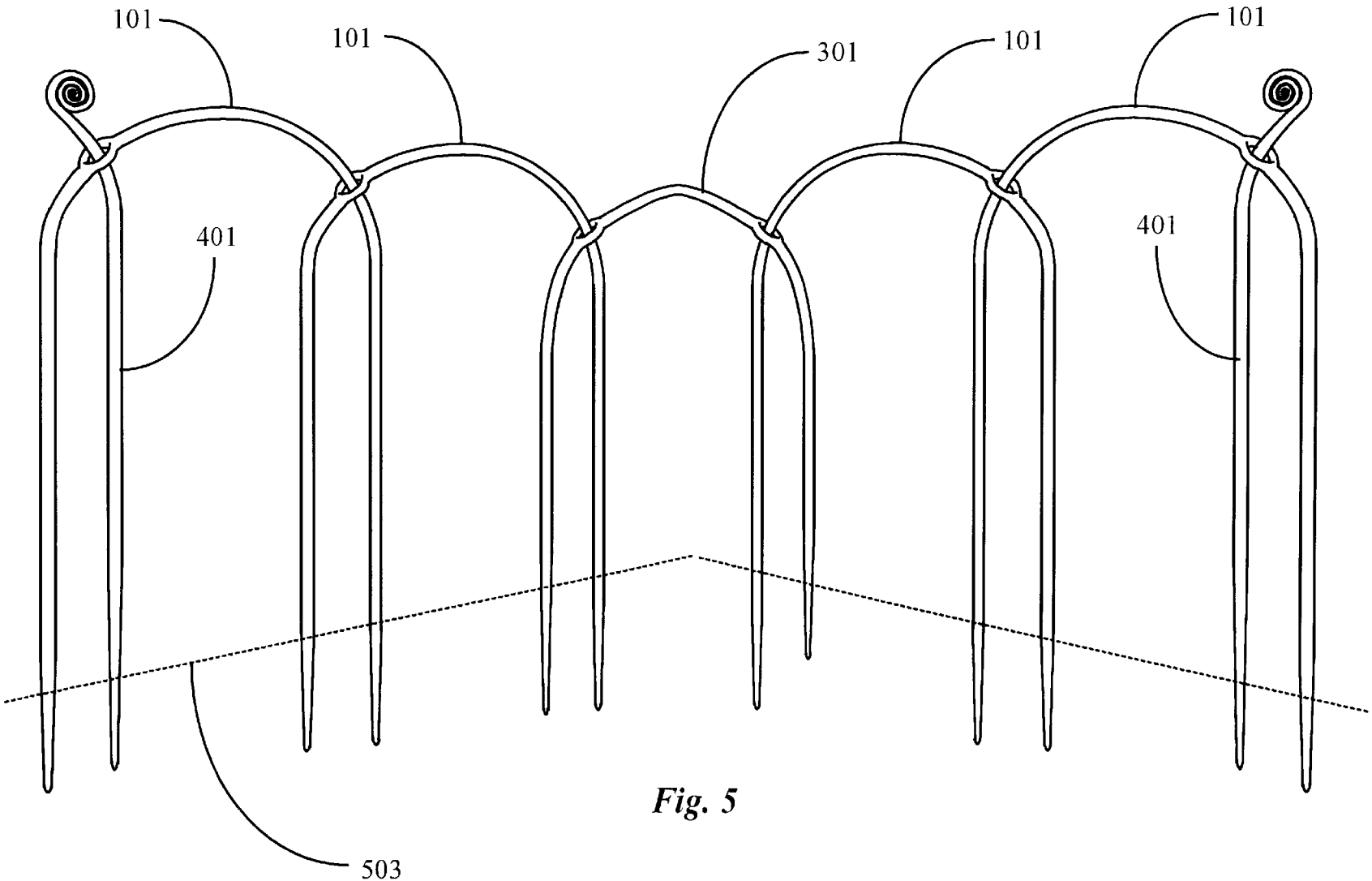
FIG. 5 is a view of the border fence sections of FIGS. 1*a*, 3*a* and 4, assembled according to an embodiment of the present invention.

FIG. 5 is an elevation view of a decorative border fence assembled using four sections 101 according to FIG. 1*a*, a corner section 301 according to FIG. 3*a* and two end sections 401 according to FIG. 4, assembled according to an embodiment of the present invention. In this view a simplified example is given to illustrate the manner in which separate fence components previously described can be installed together to form an improved decorative and functional fence system. Corner section 301 is shown in this view, facing forward with the offset angle that is incorporated into the upper portion of corner section 301 facing towards the rear. The fence in this embodiment is started at the logical starting point created by corner section 301 in the center, by first inserting corner section 301 straight down into the ground, the surface of the ground being indicated by ground line 503.

In assembly corner section 301 is pushed deeply enough into the ground so that it is fairly sturdy when released to stand on its own. At this point the tapered lower ends of corner section 301 that are inserted into the ground will be deep enough in the ground to be mostly covered in many cases, and depending on the density of the ground material into which corner section 301 is inserted, the insertion depth may vary. After corner section 301 is firmly seated, a first fence section 101 is assembled to corner section 301 by inserting the longer leg which is on the side of fence section 101 without the hole, completely through one of the two holes formed into corner section 301, lining up fence section 101 with the angle provided by corner section 301, and also firmly seating section 101 straight down into the ground using the previously described method.

Fence section 101 is also inserted into the ground to a depth similar to that for corner section 301, so as to also provide stability once seated. With corner section 301 and fence section 101 interlocked and adequately inserted into the ground, the longer leg portion of a second fence section 101 is passed through the hole of the first section 101 and, following the now defined fence line, the second fence section 101 his similarly inserted into the ground until the upper edge of the second section 101 is level with the upper edge of the first section 101. Although it is not shown in this view, the process of lining up, passing a new section 101 through the hole of a previously installed section 101, and inserting it firmly into the ground lining up the top edges, can be repeated until the desired length of fence extension is reached.

With the sections 101 assembled together and installed into the ground in such a manner, a very strong, sturdy linked-chain effect is achieved, providing a decorative ornamental fence highly resistant to damage and unwanted intrusions by people or pets. Once the logical end point of the fence is reached, a decorative end section 401 is passed through the hole of the ending fence section 101 and inserted into the ground similarly to other components described, to a depth providing sufficient support while leaving enough of the decorative upper coiled portion of end section 401 to remain extended up from the hole in section 101 at a sufficient height to be visually pleasing. Such a decorative end section 401 provides a solution to a problem previously described that is commonly encountered using conventional garden fencing such as picket fencing and many ornamental designs, such that the logical ending point of the constructed fence section is provided by the decorative end 401 itself eliminating reliance upon a wall, structure, another fence for some other natural object, for example, the provide such a logical ending point. The same process of linking fence sections together and inserting them along a predefined line into ground may be repeated on the opposite side of corner section 301 to provide fencing extending out to complete the angle. As previously described, tight curves and sharp angles of a proposed fence line can more easily be followed by utilizing such a cost-effective and time-saving fence-building method and apparatus as presented in the embodiments, due to the smaller size, lower cost of manufacture and maintenance and the modular aspect of the fence components.

In FIG. 5 no section 201 is shown as a component. It will, however, be apparent to the skilled artisan that a section 201 may be used in many cases instead of a section 301, as a starting point without a right angle requirement. It will also be apparent that there are various other arrangements and orders into which the described sections may be assembled to form decorative border fences.

It will be apparent to the skilled artisan that many variations of materials and manufacturing methods may be utilized in the construction of such fencing components as presented in these embodiments. For example, in a preferred embodiment sections are manufactured of wrought iron, galvanized steel or some other similar malleable metal, but in alternative embodiments other metals and materials may be used such as plastics, wood, aluminum, cast iron, and so on. An wide variety of coatings may also be incorporated into alternative embodiments similar to those described, such as protective powder-coatings, various galvanizations, or spray paint for example, allowing for a virtually unlimited choice of colors and levels of protection. Many different sizes of such fencing components as described may also be available to allow the user greater flexibility in achieving a visual complement between the fencing other elements within the landscape garden area. Also, many different angles other than that used for fence corner section 301 of FIG. 3*a* may be incorporated allowing the user to choose or customize the desired fencing angle starting from corner section 301. For these reasons the method and apparatus of the present invention should be afforded the broadest possible scope. The spirit and scope of the present invention should be limited only by the claims that follow:

What is claimed is:

1. A border fence comprising:

at least a first and a second substantially U-shaped element, each formed from an elongated bar having a first center line and a plane of substantial symmetry, the U-shape defining an upper curved portion ending in opposite legs extending in a first direction, each element further having a single swaged passage through the bar, the passage having a second centerline intersecting the first centerline, positioned in the curved upper portion, offset to one side of the plane of substantial symmetry, and facing in the first direction;

the border fence characterized in that the first element is seated with both legs inserted in a ground material, the second element is seated in the same manner but with one leg inserted through the single passage of the first element, and any further element is seated with one leg inserted through the passage of an immediately preceding element.

2. The border fence of claim 1 wherein the extended legs of individual ones of the elements are of different length and tapered at the free ends to facilitate insertion into ground.

3. The border fence of claim 1 wherein the passage in each element is offset to one side of the axis of substantial symmetry by a dimension such that with a leg of any one element passing through the passage of any other element, both elements may be seated at the same extended height above the ground material.

4. The border fence of claim 1 wherein the elongated bar of individual elements is formed of a malleable metal.

5. The border fence of claim 4 wherein the malleable metal is wrought iron.

6. The border fence of claim 1 wherein individual ones of the elements are treated with a protective coating.

7. The border fence of claim 1 further comprising one or more double-passage elements, one passage offset to either side of the axis of substantial symmetry, with legs of other elements of the border fence passing through each of the double passages in forming the border fence.

8. The border fence of claim 1 further comprising one or more corner double-passage elements, one passage offset to either side of the axis of substantial symmetry, with the bar of the element bent at an angle at the axis of symmetry in a plane parallel with ground, and with legs of other elements of the border fence passing through each of the double passages in forming the border fence, the corner element forming a corner of the angle bent, such that straight sections of border fence extend away from the corner element in different directions defined by the angle.

9. The border fence of claim 8 wherein the angle is ninety degrees, making a square corner.

10. The border fence of claim 1 further comprising a terminal element comprising a single straight leg with an insertion end and no passage, the leg for passing through the passage of other elements to form an end of the border fence.

11. The border fence of claim 10 wherein the terminal element comprises a decorative shape at the end opposite the insertion end of the leg.

12. An element for a border fence formed of an elongated bar having a specific cross-section and a first centerline, and comprising:

an upper portion curved through 180 degrees, having plane of substantial symmetry and a swaged passage through the bar, the passage having a second centerline intersecting the first centerline and offset to one side of the plane of substantial symmetry; and two parallel leg portions extending on opposite sides away from the upper curved portion in the direction of the passage and in a plane including the upper curved portion.

13. The fence element of claim 12 wherein the leg portions are tapered at the free ends and of different length to facilitate seating the element in ground.

14. The element of claim 12 as a first element, wherein the passage is offset to one side of the plane of substantial symmetry by a dimension such that with a leg of any identical element passing through the passage of the first element, both elements may be seated at the same extended height above the ground.

15. The element of claim 12 wherein the elongated bar is formed of a malleable metal.

16. The element of claim 15 wherein the malleable metal is wrought iron.

17. The element of claim 12 further treated with a protective coating.

18. The element of claim 12 comprising two passages, one passage offset to either side of the plane of substantial symmetry.

19. The element of claim 18 wherein the bar of the element is bent at the plane of symmetry at an angle in a plane parallel with ground, forming thereby a corner element.

20. The element of claim 19 wherein the angle is ninety degrees, making a square corner.

* * * * *